United States Patent [19]

Arieh et al.

[11] Patent Number: 4,677,771

[45] Date of Patent: Jul. 7, 1987

[54] SKI BOOT

[75] Inventors: Simon Arieh, Geneva; Guy Courvoisier, Celigny, both of Switzerland

[73] Assignee: Lange International S.A., Fribourg, Switzerland

[21] Appl. No.: 872,707

[22] Filed: Jun. 10, 1986

[30] Foreign Application Priority Data

Jun. 24, 1985 [CH] Switzerland ..... 2674/85
Mar. 4, 1986 [CH] Switzerland ..... 884/86

[51] Int. Cl.[4] ..... A43B 5/04
[52] U.S. Cl. ..... 36/120; 36/121
[58] Field of Search ..... 36/117–121

[56] References Cited

U.S. PATENT DOCUMENTS 3,619,914 11/1971 Hanson et al. .
3,713,231 1/1973 Mochizuki .
4,095,356 6/1978 Robran et al. ..... 36/121

FOREIGN PATENT DOCUMENTS 166213 1/1986 European Pat. Off. ..... 36/117
172159 2/1986 European Pat. Off. ..... 36/117
174000 3/1986 European Pat. Off. ..... 36/117
2057094 5/1972 Fed. Rep. of Germany ..... 36/117
2498061 7/1982 France .
2555418 5/1985 France ..... 36/117
2557776 7/1985 France ..... 36/117

*Primary Examiner*—James Kee Chi
*Attorney, Agent, or Firm*—Brumbaugh, Graves, Donohue & Raymond

[57] ABSTRACT

The boot consists of a shell having a lower part (1), on which is articulated an upper part (2, 3) which can pivot about a substantially horizontal pivot pin (4). This pivoting is limited by an elastic device (7) mounted between the upper part (2) and the shell (1). This elastic device comprises a rigid base (8), in the extension of which is mounted a bar of elastic material (15) having the same cross-section as the base. A tubular slide (19) slides on the base and prevents the elastic material from expanding when axial pressure is exerted on the latter. The elasticity of the device therefore varies according to the position of the slide (19). A means of axial guidance prevents the elastic material (15) from bending or buckling.

12 Claims, 10 Drawing Figures

SKI BOOT

FIELD OF THE INVENTION

The present invention relates to a ski boot which is made of at least semi-rigid material and which consists of a shell incorporating the sole and surrounding the foot and the heel and of an upper articulated on the shell about a transverse pivot pin, an elastic device being arranged between the upper and the shell so as to offer elastic resistance to the forward inclination of the upper.

PRIOR ART

There is already a known boot which incorporates an element made of elastic material, mounted at the rear in a receptacle formed between the upper and the shell (FR-A-No. 2, 498, 061). When the upper bends forwards, the elastic elastomer element is compressed between the bent lower edge of the upper and a transverse rib of the shell. The resistance of the device is not adjustable There is also a known boot which has, at the rear, a helical spring, the stiffness of which can be adjusted by means of a nut (U.S. Pat. No. 3,619,914). This device is relatively complicated and bulky, since it is necessary to have a sufficiently strong and long spring if there is to be a wide range of adjustment. If the elasticity is to be eliminated, the spring has to be compressed completely, and this requires considerable force. This device is also sensitive to the ice capable of forming in the spring and preventing it from functioning.

There has also already been a proposal to produce an elastic element consisting of elastomeric elements enclosed in a cylinder and compressed by a piston (EP-A-No. 50607). This device is not adjustable.

SUMMARY OF THE INVENTION

The object of the present invention is to produce a boot which has, at the rear or at the front, an elastic bending resistance capable of being altered easily and achieved by simple means of only little bulk having neither a helical spring nor a screw nor a nut.

The boot according to the invention is defined in that the elastic device comprises an element made of incompressible elastic material and adjustable means of limiting the length of the part of the elastic element capable of being deformed by expanding.

The incompressible elastic element can consist simply of an elastomeric bar accompanied by a guide means or not. As regards the means of adjustment, these can consist of a tube end mounted slideably on a support and surrounding a part of greater or lesser length of the elastomeric bar.

Such a device is very simple, easy to produce and insensitive to snow and ice, since even if the elastic element is surrounded at rest by a crust of ice, this is broken immediately when the elastic element expands. The adjustment is also easy to carry out, and it can be effected continuously between a position in which there is maximum elasticity and a position in which there is zero elasticity, that is to say in which the boot is rigid.

BRIEF DESCRIPTION OF THE DRAWINGS

Moreover, the device according to the invention can easily be mounted at the rear on a toggle joint. The accompanying drawings illustrate three embodiments of the invention by way of example.

DESCRIPTION OF THE EMBODIMENTS

Figure 1:
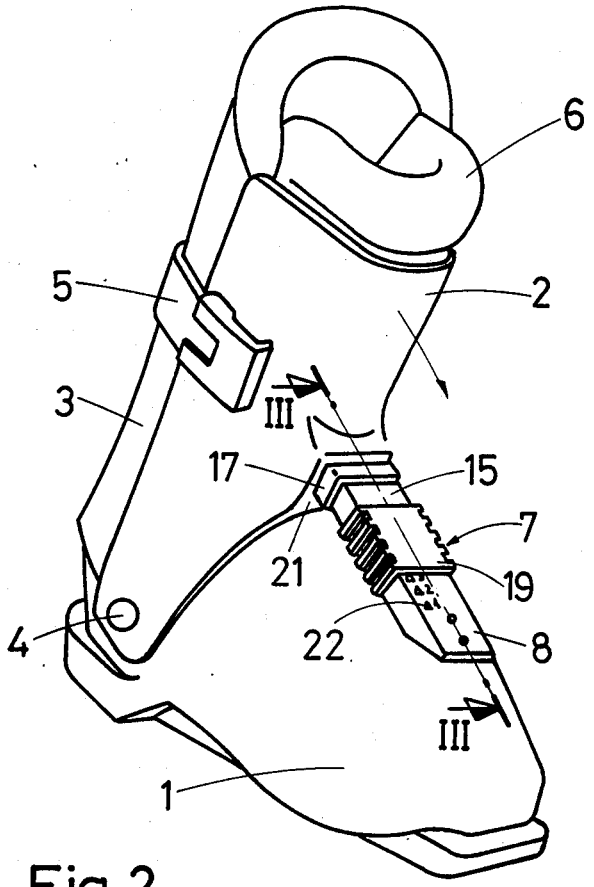
FIG. 1 is a perspective view of a ski boot equipped with a device according to the invention mounted at the front.
Figure 2:
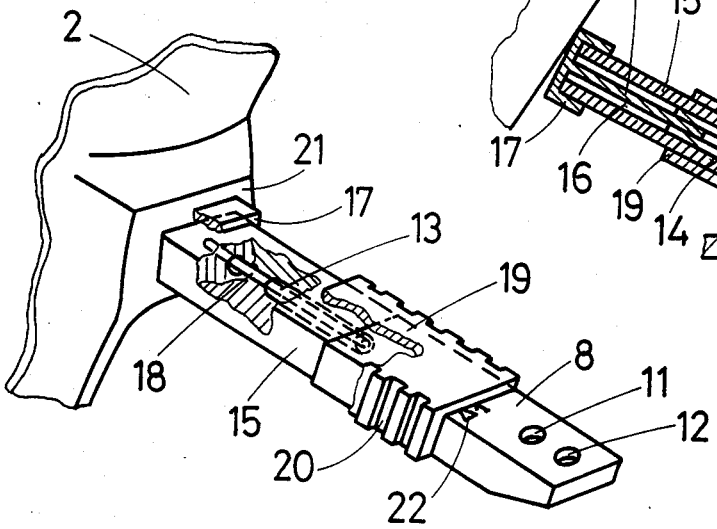
FIG. 2 is a detailed perspective view of the elastic device, with a portion cut away.
Figure 3:
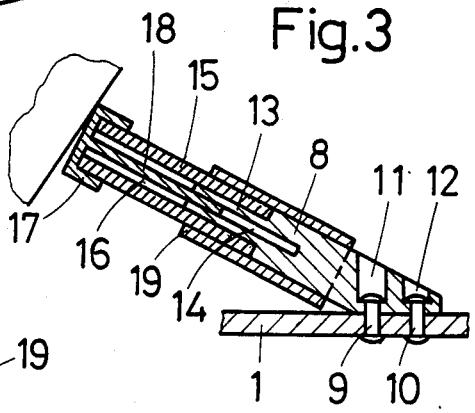
FIG. 3 is a view of the elastic device in longitudinal section along the line III—III.

The ski boot illustrated in FIG. 1 comprises a shell which is made of semi-rigid plastic and which consists of a lower part 1 incorporating the sole and surrounding the foot and the heel and two upper parts 2 and 3 articulated on the lower part 1 about a transverse pivot pin 4 approximately in the region where the foot is articulated on the leg. These parts 2 and 3 are of approximately semi-cylindrical shape and fit into one another so as to surround the skier's ankle. They are held closed by means of a buckle 5 which can be of any known type. The rear articulated part 3 can be tilted backwards so as to make it possible to put on the boot. Arranged inside the boot is a bootee 6 made of soft compressible material. Since the upper parts 2 and 3 are articulated on the lower part 1, they can be inclined forwards during skiing. The elastic resistance of an elastic device 7 fastened to the lower part of the sheel 1 opposes this inclination.

This elastic device 7 comprises a base 8 made of metal or any other rigid and resistant material, of prismatic shape with a rectangular cross-section and fastened to the boot by means of two rivets 9 and 10 embedded in holes 11 and 12. This oblique prismatic piece 8 has an axial tubular extension 13, the interior of which is extended into the base 8 by means of a blind axial hole 14. Mounted on the tubular extension 13 is a rubber bar 15 of the same rectangular cross-section as the base 8 and extending the latter. For this purpose, the rubber bar 15 has an axial cylindrical hole 16 of a diameter slightly less than the outside diameter of the tubular extension 13, so that it is retained on this tubular extension 13. The upper end of the rubber bar 15 is capped by a metal cup 17 integral with a rod 18 which passes through the axial hole 16 in the bar 15 and which engages freely into the tubular extension 13, forming with the latter a telescopic pin supporting and guiding the rubber bar 15 and preventing this bar 15 from bending or buckling when an axial pressure is exerted on the cup 17. Mounted on and around the base 8 is a tubular element of rectangular cross-section 19 which slides on the base 8 and on the rubber bar 15 extending this base. This element 19 forms a slide and for this purpose is equipped with lateral grooves 20 making it easier to actuate it. In the example illustrated, the slide 19 is retained on the rubber bar 15 simply by means of friction. However, it could also slide on the rubber bar 15 without friction and be retained on the base 8 by means of a spring or a ball mounted on a spring, interacting with notches provided on the base 8, or by any other known means.

The cup 17 is in contact with a bearing surface 21 formed on the part 2 of the shell and perpendicular to the axis of the rubber bar 15. The upper face of the base 8 is also provided with graduations 22 making it possible to mark the position of the slide 19.

The boot is shown at rest. When the skier bends his leg, the articulated part of the shell pivots forwards about the pivot pin 4 in the direction of the arrow, at the same time exerting pressure on the device 7 via its face 21. The rubber bar 15 is then deformed in the only possible way, that is to say by expanding. However, this expansion can only occur on the part of the rubber which is not surrounded by the slide 19. But the more the length of the free part of the rubber bar 15 is reduced, the higher is its resistance to deformation. From then on, the elastic device 7 behaves in the same way as an elastic element having a variable elasticity constant. The elasticity can be varied continuously or in steps if the slide moves along the base 8 in steps according to notches. The range of adjustment of the elasticity can be relatively wide for a relatively short length of the rubber bar 15. Moreover, this range of adjustment extends between a value at which the elasticity is high, that is to say the articulation of the boot is very flexible, and a value at which the elasticity is zero, that is to say when the rubber bar 15 is completely surrounded by the slide 19. Such a range of adjustment cannot be obtained by means of a metal helical spring.

If the intention is to adopt a position in which the upper part of the boot is completely free to bend forwards, it is possible to mount the elastic device 7 on the boot in such a way that it can be moved away from the bearing face 21 by pivoting it on its base either in a horizontal plane or in a vertical plane. For this purpose, it is sufficient to mount the base 8 pivotally on a pedestal, and it can be locked in the functional position by any known means, for example a bayonet system.

The device illustrated can have many alternative forms. In particular, the cross-sectional form of the elastic bar 15 can be varied infinitely. This bar can be guided by means of two telescopic pins similar to the pin 13/18 or the like. This guidance could also be obtained from outside the elastic bar 15, for example by means of lateral arms integral with the head 17.

The actual elastic element can consist of any incompressible elastic materials or combination of materials, whether or not they are elastomeric. For example, a sealed elastic casing containing a liquid could be used.

The elastic device could also be of general cylindrical shape, and this would make it possible to produce the slide 19 in the form of a nut mounted on a base having at least one threaded cylindrical part. The prismatic or cylindrical shape is not mandatory, and it is sufficient if the movable tubular element can be moved along the elastic element. Thus, the elastic device could be produced in a helical or twisted form. In general, the length of the part of the elastic element capable of being deformed by expanding could be altered by any mechanical limiting means, for example by lateral movable stops perpendicularly relative to the axis of the elastic element. However, the construction illustrated in the drawing seems to be the simplest solution.

Figure 4:
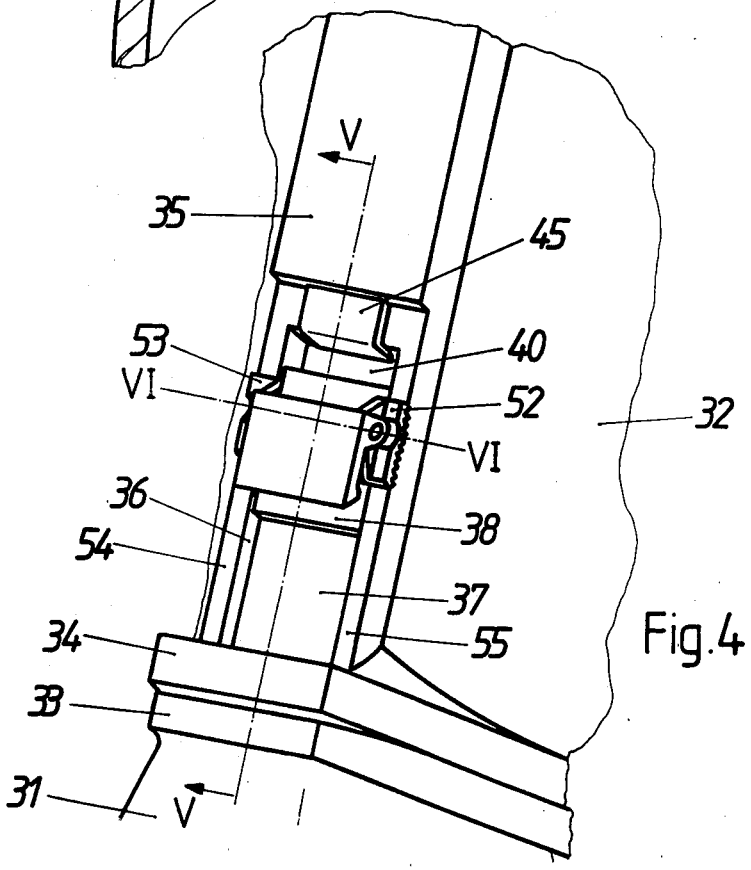
FIG. 4 is a partial perspective view of a boot according to a second embodiment.

The ski boot, of which FIG. 4 shows only part of the rear, is of the type which is put on from the top. It consists, in a way well known per se, of a lower shell 31 made of semi-rigid plastic, incorporating the sole and surrounding the foot and the heel, and of an upper 32 in one piece, having two wings which are superimposed on one another at the front of the ankle to surround the latter. The upper 32 is articulated on each side of the shell 31 at a point corresponding at least approximately to the point of articulation of the foot on the leg of the skier. The boot is also equipped with a buckle for tightening the shell and the upper on the skier's foot and ankle. The shell has a transverse reinforcing rib 33 which is located above the heel and against which the reinforced lower edge 34 of the upper comes to rest.

The reinforced back 35 of the upper 32 has a rectangular cut-out 36 extending vertically from the reinforced edge 34 of the upper above part of the shell 31. The elastic device is seated in this cut-out 36. This elastic device comprises a piece 37 of rectangular prismatic shape, preferably made of synthetic material, such as DELRIN or NYLON (registered trade marks), forming a support for a rectangular tubular piece 38 made of metal. The support 37 is attached by means of its lower end in an inner groove 39 of the reinforced edge 34 of the upper. Arranged exactly in the extension of the support 37 is a block 40 of elastomeric material, for example rubber, of the same cross-section as the support 37. The upper end of the elastomer block 40 bears against a stop integral with the shell and formed by the bend 41 of a metal plate 42 which extends under the cut-out 36 in the upper and which is fastened to the shell by means of two rivets 43 and 44. The bend 41 serving as a stop is followed by a second bend 45, the effect of which is to retain the upper 32, that is to say to prevent it from moving away from the shell 31. The surface of the plate 42 is such that the tubular element 38 and the support 37 can slide easily on this plate. Moreover, the elastic element 40 has, at its end, a projection 46 which engages into a hole in the stop 41, to retain this end of the elastic element laterally.

Welded on the tubular piece 38 is a stirrup 47, on which a lever 48 is articulated by means of a pivot pin 49. The lever 48 has two lateral cheeks 50 and 51 extending on either side of the stirrup 47 and the tubular piece 38. These cheeks form cams acting on toothed angle-shaped shoes 52 and 53 which the pivot pin 49 passes through via slots directed perpendicularly relative to the tubular element 38, in order to ensure a play in the same direction. These toothed shoes 52 and 53 bear on the longitudinal edges 54 and 55 of the cut-out 36. When the lever 48 is turned down, as shown in the drawing, its cams 50 and 51 press the toothed shoes 52 and 53 against the surfaces 54 and 55 of the upper, the effect of which is to immobilize the tubular element 38 in relation to the upper. To release this tubular element 38, it is sufficient to lift the lever 48, the effect of which is to free the shoes 52 and 53.

Figure 5:
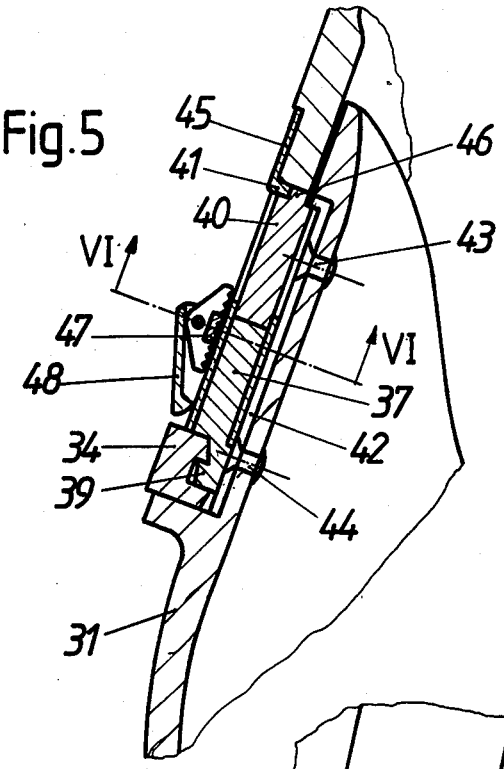
FIG. 5 is a view in longitudinal section along the line V—V of FIGS. 4 and 6.
Figure 6:
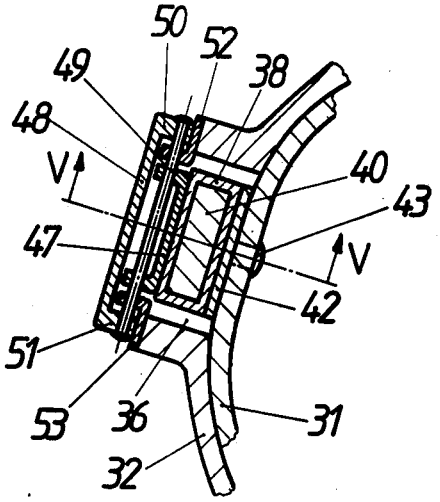
FIG. 6 is a cross-sectional view along the line III—III of FIGS. 1 and 2.

In the position illustrated in FIG. 5, the tubular element 38 is in its lower end position and the elastic element 40 is almost completely free. When the skier bends the upper 32 forwards in relation to the shell 31, the elastic element 40 is pressed between the support 37 and the stop 41 integral with the shell. Under this compressive force, it is possible for the element 40 to expand freely. The bending resistance of the boot is therefore relatively low. If the sliding tubular element 38 is now made to slide on the elastic element 40, the possibility of expansion of the latter will be progressively reduced and the bending resistance of the boot will increase progressively. FIG. 4 shows an intermediate position. When the tubular element 38 surrounds the elastic element 40 completely, it is no longer possible for the latter to expand, and because it is incompressible the elastic device becomes rigid.

The elastic piece 40 can be prevented from buckling by selecting a projection below the critical value. Another solution involves providing a telescopic guide rod which passes axially through the elastic piece 40.

The elastic device according to the invention can also advantageously be combined with a toggle joint, as shown by way of example in FIGS. 7 to 10. The ski boot illustrated in FIG. 7 likewise comprises a lower shell 61, on which is articulated a one-piece upper 62 of the same type as that of the first embodiment, that is to say having two tabs 62*a* and 62*b* which overlap one another at the front of the ankle, the upper being closed by means of a buckle 63. The upper is articulated on the shell at a point 64 located approximately in the region of the foot joint.

The back of the boot is produced in the way described in U.S. patent application Ser. No. 912,700 of the same assignee and comprises a toggle device similar to that described in the said patent application, that is to say the shell has, in the region of the heel, a rounded part 64*a*, on which slides a part 65 of matching shape of the upper, so as to allow the upper to pivot substantially to the rear. The interior of the boot is formed by a bootee 66 in a way known per se. At the rear, the shell 61 and the upper 62 are connected by means of a joint of the toggle type, comprising a lever 67 which passes through the upper via a rectangular cut-out and which at its lower end is articulated on the shell 61 by means of a pivot pin 68 and near its upper end is articulated by means of a pivot pin 69 on a link 70 articulated by means of a pivot pin 71 between a pair of parallel ribs 72 formed on the upper. In the closed position of the lever 67, illustrated in the drawing, the pivot pin 69 is located between the straight line joining the pivot pins 68 and 71 and the upper. The lever 67 of rectangular prismatic cross-section serves as a support for a tubular piece 73 of a rectangular cross-section corresponding to the cross-section of the thicker upper part of the lever 67 and mounted slideably on this part of the lever in a similar way to the tubular piece 38 of the second embodiment. The lower half 67*a* of the lever 67 is made thinner and at its upper end forms a face 67*b* perpendicular to the longitudinal axis of the lever. Arranged between this face 67*b* and the lower edge 74 of the rectangular cut-out in the upper is a piece of elastic material 75 of rectangular prismatic shape and similar to the piece 40 of the second embodiment. The upper end of this elastic piece 75 engages betweeen the tubular piece 73 and the part 67*a* of the lever.

Figure 10:
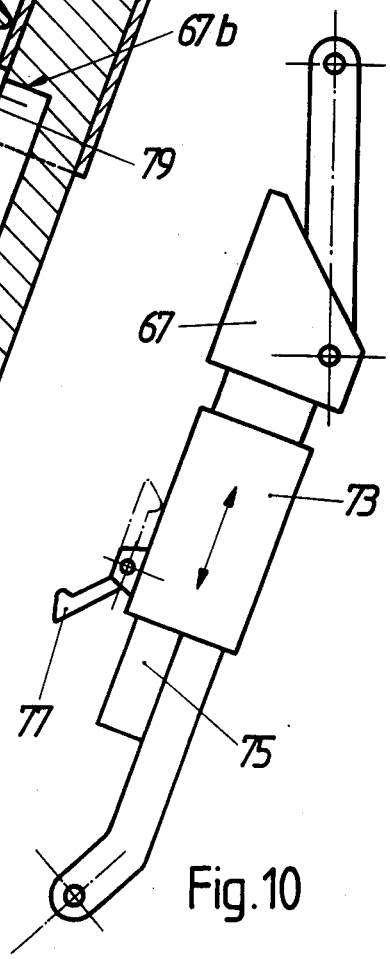
FIG. 10 is a side view of the same device in the adjustment position.

The sliding tubular piece 73 is equipped, on its outer face, with a stirrup 76, on which is articulated a lever 77 provided with a cam-shaped part 78 passing through a cut-out 79 made in the wall of the tubular piece 73 and opposite the elastic piece 75. In the turned-down position of the lever 77, its cam 78 presses against the elastic piece 75 and thus immobilizes the tubular piece 73. In the raised position of the lever 77, as shown in FIG. 10, the tubular piece 73 is released and can be moved easily, as indicated by the double arrow. Once the adjustment has been made, the lever 77 is turned down onto the sliding piece 73 which is immobilized once again in the selected position.

When the upper 62 bends forwards, the elastic piece 75 undergoes compression between the lower edge 74 of the cut-out in the upper and the face 67*b* of the lever 67. The length of the tubular piece 73 is such that it can cover the elastic piece 75 completely. In this position, the connection between the upper and the shell is rigid, and the only elasticity of the upper is the elasticity inherent in the material forming the boot.

Figure 7:
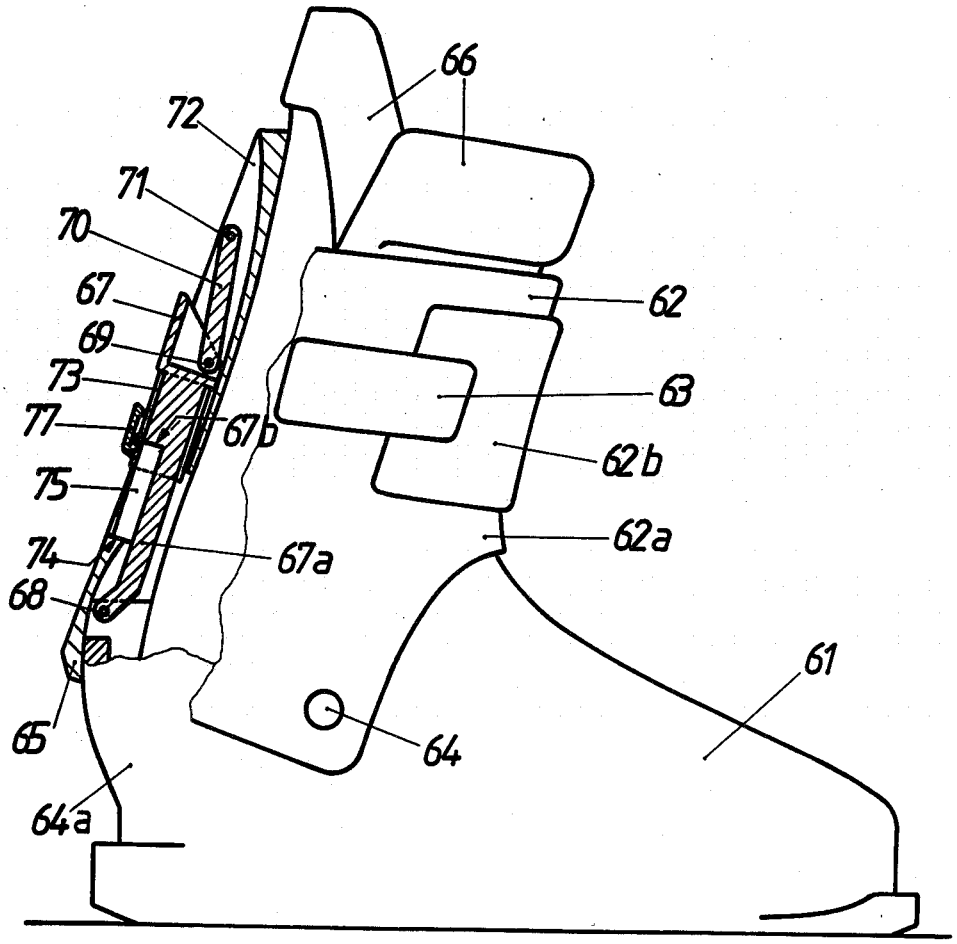
FIG. 7 shows, partially in section, a third embodiment of a boot equipped with a toggle device at the rear.
Figure 8:
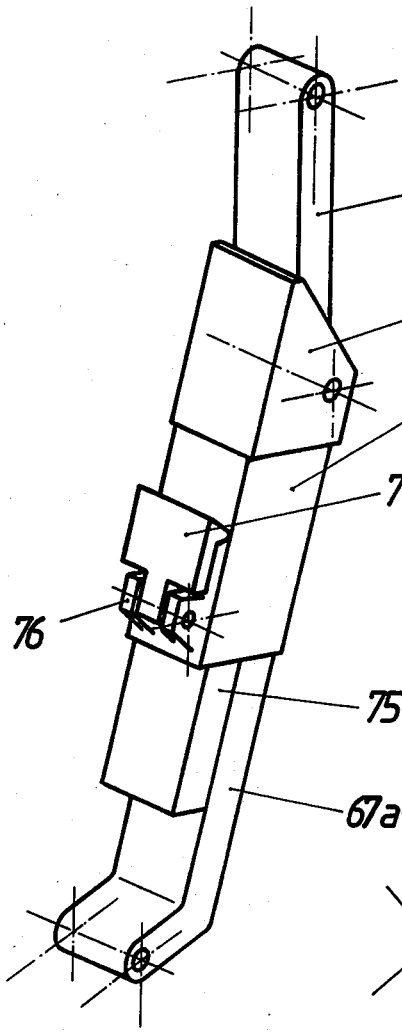
FIG. 8 is a perspective view of the toggle device of FIG. 7.
Figure 9:
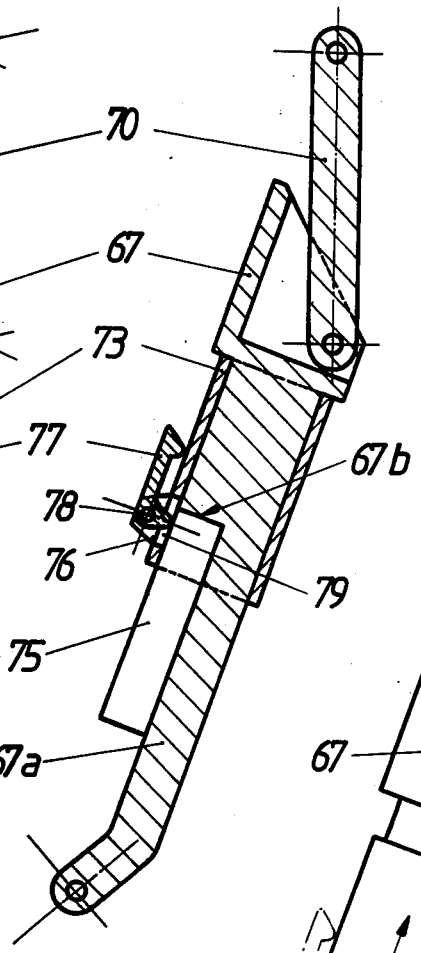
FIG. 9 is a view in axial section of the device illustrated in FIG. 8.

Furthermore, the elastic piece 75 ensures that the toggle operates effectively and makes this easier. When the three pins of the joint 68, 69 and 71 are aligned, the elastic piece 75 is actually compressed slightly. It therefore ensures that the toggle is maintained in the closed position, as illustrated in FIG. 7. When the skier wants to take off the boot or simply free the joint from the upper in the position of rest or when walking, he moves the lever 67 away from the boot and thus releases the toggle. The relative position of the joints 64 and 68 and the shape of the lower edge 74 of the cut-out in the upper are selected so that the elastic piece 75 is only slightly compressed or not compressed at all in the open position of the toggle and when the upper oscillates on the shell.

Of course, the positions of the lever 67 and of the link 70 could be reversed.

The cross-section of the elastic element, of its support and of the sliding tubular element could, of course, be other than rectangular, for example round, oval or trapezoidal.

We claim:

1. A ski boot which is made of at least semi-rigid material and which consists of a shell (1; 31; 61) incorporating the sole and surrounding the foot and the heel and of an upper (2, 3; 32; 62) articulated on the shell about a transverse pivot pin (4; 64), an elastic device being arranged between the upper and the shell so as to offer elastic resistance to the forward inclination of the upper, wherein the elastic device comprises an element made of incompressible elastic material that can be deformed by expanding (15; 40; 75) and adjustable means (19; 38; 73) of limiting the length of the part of the elastic element capable of being deformed by expanding.

2. A ski boot as claimed in claim 1, in which the elastic device (7) is mounted at the front of the boot and which has means (13, 18) of supporting and guiding the elastic element and preventing the said elastic element (15) from undergoing buckling.

3. A boot as claimed in claim 2, wherein the elastic device comprises a support (8) which is integral with the lower part of the shell and on which a sliding tubular element (19) is mounted, the elastic element (15) of constant cross-section being arranged in the extension of the said support (8) and having the same cross-section as the tubular element, so that the tubular element (19) can slide on the elastic element (15), the said supporting and guiding means consisting of at least one telescopic pin (13, 18) passing through the elastic element (15), the part of this pin opposite the said support being equipped with a head (17) intended for receiving the pressure of the upper part of the shell.

4. A boot as claimed in claim 3, wherein the support (8), the tubular element (19) and the elastic element (15) are prismatic and approximately of the same cross-section.

5. A boot as claimed in claim 3, wherein the said support (8) is articulated on the boot in such a way that the elastic device can be moved away from the upper part of the shell.

6. A boot as claimed in claim 1, in which the elastic device is mounted at the rear of the boot, wherein the elastic device comprises a support (37; 67) which is integral with one of the parts of the boot and on which a sliding tubular element (38; 73) is mounted, the elastic element (40; 75) of constant cross-section being arranged in the extension of the said support and having the same cross-section as the tubular element, so that the tubular element can slide on the elastic element.

7. A boot as claimed in claim 6, wherein the support, the tubular element and the elastic element are prismatic and approximately of the same cross-section.

8. A boot as claimed in claim 7, in which the rear lower part of the upper covers the upper edge of the shell, wherein the elastic device (40) is seated in a rectangular cut-out (36) in the part of the upper covering the shell, wherein the said prismatic support (37) is integral with the lower edge (34) of the said cut-out, and wherein the elastic element (40) extends between the end of the said prismatic support and a stop (41) integral with the shell.

9. A boot as claimed in claim 8, wherein the sliding tubular element (38) is equipped with a stirrup (47), on which is articulated a locking lever (48) provided, on either side of the stirrup with two locking cams (50, 51) interacting with the longitudinal edges (54, 55) of the said cut-out to immobilize the tubular element in the selected position.

10. A boot as claimed in claim 9, wherein the pivot pin of the locking lever supports, on either side of the stirrup, toothed shoes (52, 53) on which the said cams act.

11. A boot as claimed in claim 6, wherein the sliding tubular element (73) is equipped with a stirrup, on which is articulated a locking lever (77) provided with a locking cam (78) located above the elastic element (75), and wherein it has a cut-out (79), via which the locking cam presses against the elastic element to immobilize the tubular element in the selected position.

12. A boot as claimed in one of claims 6, 7 or 11, of which at least part of the upper (62) can be tilted to the rear on the shell (61) and incorporating a lever (67) which passes through the said part of the upper via a cut-out and is articulated at its lower end (68) on the shell and which is connected to the said part of the upper by means of a link (70), the lever and the link forming a toggle joint arranged in a vertical plane, wherein the support, on which the tubular element (73) is mounted, consists of the lever (67) of the toggle, the said elastic element (75) extending between the lower edge (74) of the said cut-out in the upper and a face (67*b*) of the support forming a stop.

* * * * *